US005276636A

United States Patent [19]

Cohn

[11] Patent Number: 5,276,636

[45] Date of Patent: Jan. 4, 1994

[54] METHOD AND APPARATUS FOR ADAPTIVE REAL-TIME OPTICAL CORRELATION USING PHASE-ONLY SPATIAL LIGHT MODULATORS AND INTERFEROMETRIC DETECTION

[76] Inventor: Robert W. Cohn, 2316 Fallsview Rd., Louisville, Ky. 40207

[21] Appl. No.: 950,633

[22] Filed: Sep. 14, 1992

[51] Int. Cl.[5] ..... G06E 3/00

[52] U.S. Cl. ..... 364/822; 359/561

[58] Field of Search ..... 364/819, 820, 822, 604; 359/561, 29

[56] References Cited

U.S. PATENT DOCUMENTS

| | | | |
|---|---|---|---|
| 4,383,734 | 5/1983 | Huignard et al. | 359/561 |
| 4,449,193 | 5/1984 | Tournois | 364/604 |
| 4,588,260 | 5/1986 | Horner | 364/822 X |
| 4,669,054 | 5/1987 | Schlunt et al. | 364/604 X |
| 4,695,973 | 9/1987 | Yu | 364/822 |
| 4,765,714 | 8/1988 | Horner et al. | 364/822 X |
| 4,954,789 | 9/1990 | Sampsell | 359/318 |
| 5,040,140 | 8/1991 | Horner | 364/822 |

OTHER PUBLICATIONS

Fielding et al, "Optical Fingerprint Identification by Binary Transform Correlation", Opt. Eng. 30, 12, 1958-61, Dec. 1991.

Weaver et al, "A Technique for Optically Convolving Two Functions", Appl. Opt. 5, 1248 (1966).

Lugt, "Signal Section by Complex Spatial Filtering", IEEE Trans. Information Theory, IT-10, 139-145 (1964).

Horner et al, "Phase-Only Matched Filtering", Appl. Opt. 23, 6, 812-16 (15 Mar. 1984).

Upatnieks, "Portable Real-Time Coherent Optical Correlator", Appl. Opt., 22, 18, 2798-2803 (15 Sep. 1983).

Yu et al, "Adaptive Real-Time Pattern Recognition Using a Liquid Crystal TV Based Joint Transform Correlator," Applied Optics, 26, 8, 1370-72 (15 Apr. 1987).

Javidi, "Nonlinear Joint Power Spectrum Based Optical Correlation", Appl. Opt., 28, 12, 2358-66 (15 Jun. 1989).

Kotzer et al, "Phase Extraction Pattern Recognition," Applied Optics, vol. 31, 8, pp. 1126-1136 (10 Mar. 1992).

Lessem et al., "The Kinoform: a New Wavefront Reconstruction Device," IBM J. Res. Dev. 13, 150-155 (1969).

Horner, "Light Utilization in Optical Correlators," Appl. Opt., 21, 24, 4511-14, (15 Dec. 1982).

Horner et al, "Pattern Recognition With Binary Phase-Only Filters", Applied Optics, 24, 5, 609-11 (1 Mar. 1985).

Cohn, "Random Phase Errors and Pseudo-Random Modulation of Deformable Mirror Spatial Light Modulators," Proc. SPIE V. 1772-34 (1992).

Knopp et al, "Optical Calculation of Correllation Filters" Proc. SPIE V. 1295, 68-75 (1990).

Fielding et al, "1-f Binary Joint Transform Correlator", Opt. Eng. 29, 9, 1081-87 (Sep. 1990).

Florence, "Joint-Transform Correlator System Using Deformable-Mirror Spatial Light Modulators," Opt. Lett., 14, 7, 341-43 (1 Apr. 1989).

(List continued on next page.)

*Primary Examiner*—Tan V. Mai

*Attorney, Agent, or Firm*—Middleton & Reutlinger

[57] ABSTRACT

A video-rate correlator constructed with a phase-only spatial light modulator and video camera. The phases of the Fourier spectra of a test and reference image are measured by real-time fringe scanning interferometry. The two phase images are then electronically subtracted. The optical Fourier transform of this difference produces the phase-only correlation response. This correlator is real-time adaptive, in that it uses live imagery, and neither the test or reference images need any preprocessing off-line. Especially small optical layouts, which also efficiently use light for correlation, can be configured through the use of specific embodiments, which use only a single phase-only spatial light modulator and Fourier transform lens.

5 Claims, 9 Drawing Sheets

OTHER PUBLICATIONS

Amako et al, "Kinoform Using an Electrically Controlled Birefringent Liquid-Crystal Spatial Light Modulator," Appl. Opt. 30, 32, 4622-28 (10 Nov. 1991).

Lu et al, "Complex Amplitude Reflectance of the Liquid Crystal Light Valve," Appl. Opt., 30, 1374-78 (1991).

Hornbeck, "Deformable-Mirror Spatial Light Modulator", Proc. SPIE 1150, 86-102 (1989).

Boysel et al, "Deformable Mirror Light Modulators for Image Processing," Proc. SPIE 1151, 183-194 (1989).

Gregory et al, "Optical Characteristics of a Deformable Mirror Spatial Light Modulator," Opt. Lett., 13, 1, 10-12 (Jan. 1988).

Boysel, "A 128×128 Frame-Addressed Deformable Mirror Spatial Light Modulator," Opt. Eng., 30, 9, 1422-27 (Sep. 1991).

Gregory et al, "Full Complex Modulation Using Liquid-Crystal Televisions" Applied Optics, vol. 31, 2, pp. 163-165 (10 Jan. 1992).

Bruning et al, "Digital Wavefront Measuring Interferometer for Testing Optical Surface and Lenses," Appl. Opt. 13, 11, 2693-2703 (Nov. 1974).

Ichioka et al, "Direct Phase Detecting System," Applied Optics, vol. 11, 7, pp. 1507-1514 (Jul. 1972).

Neff, "Major Initiatives for Optical Computing," Optical Engineering, vol. 26, pp. 2-9 (Jan. 1987).

METHOD AND APPARATUS FOR ADAPTIVE REAL-TIME OPTICAL CORRELATION USING PHASE-ONLY SPATIAL LIGHT MODULATORS AND INTERFEROMETRIC DETECTION

BACKGROUND OF THE INVENTION (a) Field of the Invention

The present invention relates to the field of optical correlators which are used to recognize patterns in two dimensional images; more specifically, correlators which both recognize patterns at the image frame rate of the video images being examined, that is to say at a real-time rate, and which can have their reference image programmed, meaning updated or replaced, at video rates or even faster. Even more specifically, the present invention relates to correlators which can adaptively update their reference image, that is to say program themselves with new references at or near real-time, from recently observed video images. Typical video frame rates are 30 frames per second. The technologies of my invention are even capable of much faster image frame rates.

(b) Description of the Prior Art

The mathematical operation of correlation is widely applicable to the recognition of patterns (e.g. characters, faces, fingerprints, vehicles) in images and autonomous guidance of robotic systems by images. Many varied applications, including use in radar and communication systems, and parts inspection systems, have been taught in prior United States patents; such as, for example, U.S. Pat. No. 4,695,973 to Yu; U.S. Pat. No. 4,765,714 to Horner. See, also, K. H. Fielding, J. L. Horner and C. K. Makekau, "Optical fingerprint identification by binary transform correlation," Opt. Eng., 30, 12, 1958–61 (December, 1991). Potential future applications include use as part of optical neural network architectures and optical associative memories. Whether a correlator is used in these typically real-time systems often depends on the time required to perform the correlations.

The correlation integral can be calculated by digital computers, but when correlating long length signals, the number of computer operations can often take too much time. Fast correlation is often performed using the Fast Fourier Transform (FFT) algorithm on a computer. The number of operations for the FFT is known to be $N \log_2 N$ complex adds and multiplies, where N is the number of points to be correlated. (In a video image this might be as large as $1000 \times 1000$ pixels or 1 million points.) One complex add and multiply is equivalent to 4 real adds and 4 real multiplies. Three FFTs are required to perform a correlation, so correlation requires 0.5 billion floating point operations. Recent Cray computers (circa 1991, 2 gigaflops) would be able to compute only 4 image correlations per second, would consume much energy, and are quite large and expensive. Furthermore, if customized programming is required for a specific application of correlation, then, substantial costs are frequently involved.

Specialized analog signal processors have been developed for real-time applications that are too taxing for digital computers. In addition to their equivalent computation rates, analog processors can be smaller, lighter and more energy efficient.

Optical correlators perform the equivalent of the mathematical operation of correlation between two images (or signals) in an analog fashion, based on the physical properties of optical waves and the response of photosensitive (or photodetecting) materials to optical waves. The operation of coherent optical correlators ("optical correlator") is based on the interference of nearly monochromatic optical waves (primarily lasers). Any optical correlator takes two images as input, one considered the object to be identified (template, reference image) the other being the image to be inspected (scene image, test image). The image at the output of the correlator (correlation plane) represents the correlation integral of the two images. If two images are similar in shape, size and variation in intensity, the input is transformed into a narrow, large intensity peak in the correlation plane. The location of the peak is exactly proportional to the lateral offset between the correlated objects in the two images. Typically, a video camera views and records the correlation plane. A computer or electronic system can then simply and quickly examine the correlation plane image on a pixel-by-pixel basis to determine if the intensity exceeds a threshold for positive identification, and if so, record the pixel location (locations) of the correlated object (objects).

The actual reference image (and in some variants the test image) is introduced into various correlators in different ways. In the case of the joint transform correlator (JTC), both images are placed side-by-side in an object (image) plane. This is to say that transparencies of the two images are illuminated by a uniform intensity plane wave, or in practice, by a collimated beam of laser light. See C. S. Weaver and J. W. Goodman, "A technique for optically convolving two functions," Appl. Opt. 5, 1248 (1966). In the Vander Lugt correlator (VLC), a complex-valued transmittance (reflectance), called a matched filter, is placed at the focal plane (Fourier plane, filter plane) of the correlator. The filter transmittance is proportional to the complex conjugate of the Fourier transform spectrum of the input image. See A. Vander Lugt, "Signal Detection by Complex Spatial Filtering," IEEE Trans. Information Theory, IT-10, 139–145, 1964. It is known that the complex wave amplitudes found at the focal plane, resulting from illuminating the input image, are well approximated by the Fourier spectrum of the image. See J. W. Goodman, Introduction to Fourier Optics, McGraw-Hill, 1968. The complex transmittance of the matched filter is generated by a holographic recording process. The nonlinear recording properties of photosensitive materials (e.g. square law) necessarily records other terms. Proper recording procedures enable the non-correlation part of the transmittance to reconstruct at an adequate distance from the center of the correlation plane, so that there is little interference from these terms. However, these other terms also reduce the amount of light that diffracts into correlation peaks, increase noise, reduce dynamic range of the correlator, and cause the holographic recording to have a higher spatial resolution (maximum number of resolvable pixels, space-bandwidth) than would otherwise be needed if the complex-valued matched filter alone was available. Designing arbitrary complex-valued filters without recording nonlinear terms has generally been considered to be impractical. Recent real-time complex valued filters are discussed below in the Background discussion of Spatial Light Modulators (SLMs). Detail on the theory and properties of the classical matched filter and the related correlation receiver is taught in P. LaFrance, *Funda-*

*mental Concepts in Communication,* Ch. 2, Prentice-Hall, Englewood Cliffs, N.J. (1990).

The JTC also uses a holographic recording procedure, but, in this case, the interference pattern of the complex spectra of scene and reference images expose the film at the focal plane of the correlator. Reconstruction of this hologram also contains a correlation plane, as well as other non-correlation terms, which degrade the correlation plane in similar manner as noted for the VLC.

In a phase-only correlator (POC), a phase-only filter replaces the matched filter of the Vander Lugt correlator. This filter is identical to the matched filter in phase but its magnitude is set to one. See J. L. Horner and P. D. Gianino, "Phase-only matched filtering," Appl. Opt., 23, 6, 812-16 (15 March, 1984). Computer designed phase-only filters have also been referred to as kinoforms. See L. B. Lessem, P. Hirsch, and J. A. Jordan, Jr., "The kinoform: a new wavefront reconstruction devices," IBM J. Res. Dev., 13, 1520 (1969). The phases for the phase-only filter are typically calculated from a FFT of the image, where the FFT (with an adequate number of samples) well approximates the Fourier transform relationship between the object and focal plane. Such filters are usually manufactured by forming a relief structure on a glass plate by photolithographic etching procedures, such as, for example, those procedures used in semiconductor processing. The manufacturing procedure is especially easy if only binary phases are implemented. These type of correlators are especially desirable, in that they can have 100% diffraction efficiency, as taught in J. L. Horner, "Light utilization in optical correlators," Appl. Opt., 21, 24, 4511-14, (Dec. 15, 1982). That is, all the light energy can be focused into a single intensity peak in the correlation plane. Phase-only filtering in the frequency plane of a correlator has the advantage in detecting objects over Vander Lugt correlation of narrower correlation peaks but a greater sensitivity to scale and rotation changes. See Horner U.S. Pat. No. 4,588,260.

A special case of the POC is the binary phase-only correlator (BPOC). See Horner U.S. Pat. No. 4,765,714. The filter in the BPOC differs from the POC in that phases of the POC closer to 0 than $\pi$ are mapped to 0, and phases closer to $\pi$ are mapped to $\pi$. Deterministic simulations, see J. L. Horner and J. R. Leger, "Pattern recognition with binary phase-only filters," Applied Optics, 24, 5, 609-11 (Mar. 1, 1985); and analysis of phase truncation as a random process, see R. W. Cohn, "Random phase errors and pseudo-random modulation of deformable mirror spatial light modulators," Proc. SPIE V. 1772-34 (1992); both indicate that the BPOC is only 40% as efficient as the POC at directing light into the correlation plane While the BPOC is more efficient than the VLC and JTC, it is still less efficient than the POC. The increased levels of noise in the BPOC are also analyzed in R. W. Cohn.

In many systems, it is often necessary to perform correlation on each test image as it is presented to the system. Thus, for optical correlators to perform in real-time, it is necessary that each test image must be displayed on a spatial light modulator capable of real-time rates. An even more flexible correlator would allow one or more reference images to be compared against each test image. In this case, a real-time spatial light modulator is needed for the reference image as well, in which case the correlator is said to be programmable. The most flexible correlator is said to be "adaptive" if it is capable of being programmed with new reference images from recently observed images. Adaptive correlators are a special case of programmable correlators. Nonadaptive programmable correlators only use precalculated, prestored or prerecorded images to update the reference image.

There are specific optical correlator realizations that have demonstrated differing degrees of flexibility. As early as 1977, a VLC using a real-time SLM in the input plane and a permanently recorded hologram in the focal plane demonstrated real-time operation, though non-programmable and non-adaptive. See J. Upatnieks, "Portable real-time coherent optical correlator," Appl. Opt., 22, 18, 2798-2803 (Sep. 15, 1983) and references therein. Programmable and adaptive operation using rewrittable materials, e.g. thermoplastic films, photorefractive crystals and liquid crystal light valves, at the filter plane has more recently been taught. See U.S. Pat. No. 4,383,734. Recent JTCs have demonstrated adaptive real-time operation. Test and reference images are placed on adjacent halves of a single electrically-addressed SLM in the input plane. The intensity of the resulting Fourier plane image is recorded by a video camera. Photodetection of the resulting image is basically equivalent to the nonlinear detection process used for making holograms, though the cameras used usually have much lower resolution. The camera, as opposed to film, is a real-time device. Its signal is fed to a video-rate SLM, e.g. a liquid crystal display from a hand held television. The Fourier transform of this transmittance by a second lens system forms the desired correlation plane image. See Yu U.S. Pat. No. 4,695,973 and F.T.S. Yu, S. Jutamulia, T. W. Lin, D. A. Gregory, "Adaptive Real-Time Pattern Recognition Using a Liquid Crystal TV Based Joint Transform Correlator," Applied Optics, 26, 8, 1370-72 (Apr. 15, 1987).

The most flexible POC envisioned to date would use a real-time input plane SLM and a real-time phase-only SLM in the filter plane. It is programmed by selecting one of a set of images representing the phase at each individual pixel of the SLM in an electronic (or optical) memory. Adaptive operation of the POC is impractical if the phase weights are determined by FFT, because of the computation time of the FFT and because the optical correlator is being used to eliminate the need for digital computation of the FFT. Thus, while JTC offers small size and adaptivity, it suffers from poor utilization of light when compared with the POC. The POC, however, is not adaptive.

The good performance of phase-only filters and the prior lack of real-time, phase-only SLMs has led to recent approaches in which the filter plane of an optical correlator approximates the characteristics of the phase-only filter. Mathematical analyses show that for specific nonlinear mappings of detected filter plane intensities, specific terms of a harmonic expansion are equivalent to the phase of the phase-only matched filter. The other harmonic terms primarily reduce the energy diffracted into the phase-only correlation peak. Demonstrations of both the JTC and a more recent "phase-extraction" correlator achieved performance which, in principle, is equivalent to a POC. While each correlator is capable of real-time adaptive operation, similar to JTC and VDL, the other nonlinear harmonics reduce the amount of light used for correlation to a small fraction of the light available for a true POC. See B. Javidi, "Nonlinear joint power spectrum based optical correlation," Appl. Opt., 28, 12, 2358-66 (Jun. 15, 1989) and T.

Kotzer, J. Rosen, and J. Shamir, "Phase extraction pattern recognition," Applied Optics, Vol. 31, 8, pp. 1126–1136 (Mar. 10, 1992).

Adaptive correlation has recently been demonstrated for the BPOC. See J. Knopp and S. E. Monroe, Jr., "Optical calculation of correlation filters," Proc. SPIE V. 1295, 68–75 (1990). The sign of the optical spectrum was determined from video images of the intensity of 1) the optical spectrum, 2) a reference beam, and 3) the interference pattern of the spectrum and reference beam. Mechanical shuttering is required to present each of the three images to the filter plane camera. A phase-only SLM in the filter plane is then programmed with either the value 0 or $\pi$ based on the measured sign. The authors mentioned that with the addition of a phase shifter and by recording a second interferogram, the determination of the phase would be possible, but that they were mainly interested in the small amount of computer calculations needed to decide on the sign.

Because of the low optical efficiency of the BPOC and the low fill factor of their spatial light modulator, decentering in the image plane (equivalent to tilt in the filter plane) was required to separate the correlation peak from the residual test image. In Kotzer et. al. tilt was used for the same reason, and in the JTC separation of reference from test image was used for this reason. In fact, the VLC was not the first approach that recorded complex weights; but by recording with a tilted reference it was for the first time possible to separate terms involved in correlation from those not involved. See Chapters 7 and 8 of Goodman.

Only today with the development of SLMs that can practically implement a full $2\pi$ phase modulation is it practical to remove the restrictions of tilted recording wavefronts. Using full $2\pi$ phase modulation, it now appears possible to direct all energy into correlation, which eliminates the need for a tilted reference; which has the addional advantage of not requiring as large optical apertures and, hence, lower cost optics.

Physically compact implementations are currently desired for many systems. Recent JTC demonstrations have achieved smaller size by using a single SLM, lens and video camera for both recording and reconstruction steps of the correlation process. This is often called "time-sharing of the optics." See Horner U.S. Pat. No. 5,040,140; K. H. Fielding and J. L. Horner, "1−f binary joint transform correlator," Opt. Eng., 29, 9, 1081–87 (Sep. 1990); and J. M. Florence, "Joint-transform correlator systems using deformable-mirror spatial light modulators," Opt. Lett., 14, 7, 341–43 (Apr. 1, 1989).

It is worth summarizing the basic similarities and distinctions between the various optical correlators described above. Each correlator by optical or opto-electronic means records phase of the Fourier spectrum of an image. Phase is usually recorded by holographic-/interferometric techniques and reconstructed by holographic reconstruction or opto-electronic decoding and then programming of an SLM. One exception is using the FFT to electronically find the complex weights, but this is not practical for real-time adaptive correlators. The various techniques have demonstrated useful properties of real time operation, adaptivity, efficient use of light and compact size. None have achieved all these properties simulataneously.

(c.) Background on Enabling Technologies Used in My Invention

(1.) Spatial Light Modulators (SLMs)

Various SLMs have been developed and demonstrated over the years that can amplitude or phase modulate laser beams. Modulation is set, or programmed, onto an SLM by either optical or electric addressing. Optical addressing means that the modulation at a specific pixel on the SLM is controlled by the intensity of light at that location. In electrical addressing, control voltages are varied at the local pixel sites. Many SLMs use the voltage-dependent birefringence of liquid crystals to perform either amplitude or phase modulation. Amplitude modulation is performed by using birefringence to rotate the polarization of light. A polarizer, placed in front of the light, converts the polarization modulation into amplitude modulation. Phase modulation is performed by aligning the polarization of incident light along one of the two principal axes describing the refractive index of the crystal. The amount of phase shift is determined by the voltage-dependent change in the velocity of the optical wave in the crystal. The response time of the liquid crystal usually limits the SLMs to image frame rates below 100 frames per second. Ferroelectric liquid crystals and magneto-optic materials also appear to be practical for frame rates up to 10,000 frames per second, but they only switch between one of two polarizations. For additional information on phase-only and amplitude-only modulation of liquid crystal SLMs, see J. Amako and T. Sonehara, "Kinoform using an electrically controlled birefringent liquid-crystal spatial light modulator," Appl. Opt., 30, 32, 4622–28 (Nov. 10, 1991) and references therein; and, K. Lu and B. E. A. Saleh, "Complex amplitude reflectance of the liquid crystal light valve," Appl. Opt., 30, 1374–78 (1991).

A specific SLM that appears especially promising for phase-only spatial filtering is the Flexure-Beam Deformable Mirror Device (FBDMD). See Sampsell U.S. Pat. No. 4,954,789; L. J. Hornbeck, "Deformable-mirror spatial light modulators," Proc. SPIE 1150, 86–102 (1989); and, R. M. Boysel, J. M. Florence, and W. R. Wu, "Deformable mirror light modulators for image processing," Proc. SPIE 1151, 183–194 (1989). The current FBDMD consists of a 128×128 array of 46 μm×46 μm micromechanical mirrors on 50 μm centers. Each mirror is suspended over an individually addressable field plate that deflects the mirror in a piston motion through electrostatic attraction. Experiments with individual pixels have demonstrated a range of $4\pi$ phase retardation for visible wavelength light. A DMD with cantilever beam tilt-producing micromechanical mirrors has already been integrated on top of the same addressing circuit and demonstrated. See D. A. Gregory, R. D. Juday, R. Gale, J. B. Sampsell, R. W. Cohn and S. E. Monroe, Jr., "Optical characteristics of a Deformable Mirror Spatial Light Modulator," Opt. Lett., 13, 1, 10–12 (Jan. 1988) and R. M. Boysel, "A 128×128 frame-addressed deformable mirror spatial light modulator," Opt. Eng., 30, 9, 1422–27 (September, 1991). Video rates up to 4000 video frames per second were demonstrated. Pixellated piston-only SLMs can be set to closely approximate the phase of any wavefront if the spatial variation of the wavefront is less than the Nyquist rate, i.e. its phase varies by less than $\pi$ radians per pixel. For more discussion of the sampling theorem, see A. V. Oppenheim and R. W. Schafer, *Digital Signal Processing,* Prentice-Hall, Englewood Cliffs, N.J. (1975).

No SLM as yet has been capable of arbitrary programming of amplitude and phase. However, a phase-only and amplitude-only SLM may be used in tandem to achieve full-complex modulation. See D. A. Gregory, J. C. Kirsch, and E. C. Tam, "Full complex modulation using liquid-crystal televisions," Applied Optics, Vol. 31, 2, pp. 163-165 (Jan. 10, 1992). In correlators, the added expense of using two SLMs simultaneously may not be justified in light of the excellent performance of phase-only correlators.

(2.) Fringe Scanning Interferometry

There has been much development of real-time measurement of phase from video imaged interferograms. The most popular approach is fringe-scanning interferometry. See J. H. Bruning, D. R. Herriott, J. E. Gallagher, D. P. Rosenfeld, A. D. White, and D. J. Brangaccio, "Digital Wavefront Measuring Interferometer for Testing Optical Surfaces and Lenses," Appl. Opt., 13, 11, 2693-2703 (Nov. 1974). In this procedure, at least three interferograms of the same object are recorded Each recording differs, in that there is a different phase offset in the reference arm of the interferometer. With three interferograms, two linear equations can be exactly solved for the real and imaginary transmittance (reflectance) of the object at each pixel. Rectangular to polar conversion gives the amplitude and phase of the object under test. Fringe scanning measurements of phase, and related surface topography, is typically found by computer evaluation of the digitized images. In the early articles, computer evaluation took around one minute. This was referred to as "real-time", which was adequately fast for testing optical components. Even today, with faster computers, optics testing does not seem to require interferometers that operate at video rates of 30 frames per second. If an interferometer is used in an adaptive optical telescope, it must be able to measure phase changes at around 4000 frames per second, in order to be able to compensate for blurring caused by turbulence in the atmosphere.

An earlier method teaches using a single interferogram. A periodic fringe pattern is formed by tilting the reference beam with respect to a perfectly planar test surface. Any deviations from periodicity indicate deviation of the surface from a planar shape. Thus, the fringes are viewed as a phase modulated carrier signal. The interferogram phase can then be demodulated from the serial video signal using a quadrature demodulation circuit. See Y. Ichioka and M. Inuiya, "Direct Phase Detecting System," Applied Optics, Vol. 11, 7, pp. 1507-1514 (July, 1972). The mathematical formulation is essentially identical to that used in known radio frequency (RF) communication circuit demodulators. See K. K. Clarke, D. L. Hess, "FM demodulators," Ch. 12. *Communication Circuits: Analysis and Design,* Addison-Wesley, Reading, Mass. (1971).

The mathematics describing fringe scanning interferometry is also similar to that of FM demodulators. In this case, samples of the interferogram are recorded at discrete values of phase offset, which is equivalent to discrete-time samples of a continuous wave (CW) modulated RF signal. The fringe scanning method has the advantage over the single interferogram method described above, in that each pixel may be evaluated independently of neighboring pixels. For a discussion of phase measuring interferometers, see J. Schwider, "Advanced Evaluation Techniques in Interferometry," pp. 271-359 and *Progress in Optics,* E. Wolf, Ed., Vol. 28, Elsevier, Amsterdam, The Netherlands (1990).

SUMMARY OF THE INVENTION

The present invention involves performing optical correlation by measuring the phase of the Fourier spectra of a test image and a reference image by a measurement technique generally referred to as fringe-scanning or phase shift interferometry. A small amount of electronics is used to decode the phase in real-time from serial video signals containing the interferometric measurements. The algebraic difference of the measured phase of the two spectra is then used to identically modulate a phase-only spatial light modulator. The Fourier transform of the phase modulation, by means of laser beam illumination through the SLM and a lens, produces the desired correlation in a plane one focal length from the lens.

More specifically, the method of the present invention performs optical correlation by using lenses to Fourier transform live images of the test and reference images represented on spatial light modulators; by then interfering these light distributions representing the Fourier transforms with plane wave references that are phase-shifted from each other by known amounts; by then recording the interference patterns with a real-time image sensor, such as a video camera; by then decoding the phase of the test and reference spectra from the interferograms using electronic circuitry; by then subtracting the decoded phase of the test spectrum from the reference spectrum and identically modulating the phase of a phase-only spatial light modulator with the phase difference; by then using a lens to Fourier transform the phase only modulation; and, finally, by using a real-time image sensor to record (and additional auxiliary circuitry to evaluate) the intensity of the Fourier transform which represents the correlation plane.

The present invention overcomes the limitations of previous optical correlators, as described above, in that it simultaneously achieves high diffraction efficiency, compact size, and real-time programming of both test and reference images from arbitrary (including live) sources. This is accomplished by real-time detection of the phase of the Fourier spectra of the reference and test images, and representation of the detected phase on phase-only spatial light modulators. High diffraction efficiency results from the use of phase-only spatial light modulators in the Fourier plane in all embodiments and in some embodiments in the test and reference image planes as well. Compactness is achieved in specific embodiments that use the same optics to perform all three optical Fourier transforms, those being: first—test image to Fourier plane; second—reference image to Fourier plane; and, third—Fourier plane to correlation plane. Further compactness is achieved by simultaneously using the same phase-only spatial light modulator to provide specific phase offsets needed to be able to decode the phase at each pixel location from three video-captured interferograms. Further compactness is achieved by using Fourier transform lenses as part of the illuminator for the reference plane wave in the interferogram. The greatest speeds are achieved by using a small amount of analog, rather than digital, serial circuitry to decode the phase from three or more successive video-captured interferograms. Furthermore, my invention, as have many previous optical correlators, permits the measurement of amplitude, so that both amplitude and phase may be simultaneously decoded. Thus, by using a spatial light modulator capable of arbitrary representation of amplitude and phase, the correlator need not be limited to phase-only filtering, but would admit the full-complex filtering as defined for the classical matched filter correlator.

More particularly, my apparatus for performing optical correlation of a complex-valued two-dimensional test image and a complex-valued two-dimensional reference image comprises: means to determine the Fourier spectrum of a test and a reference image and produce a test image Fourier transform light distribution and a reference image Fourier transform light distribution; means to interfere said test and reference image Fourier transform light distributions with three reference plane waves, said reference plane waves being phase-shifted from each other by known amounts, thereby producing three test image and three reference image interferogram patterns; means to electronically convert with a real-time image sensor the recorded three test image interferogram patterns into a test image phase signal and convert the three reference image interferogram patterns into a reference image phase signal; means to subtract the reference image phase signal from the test image phase signal to yield a difference signal and identically modulate a phase-only spatial light modulator with the difference signal producing a phase-only transmittance signal; and, means to Fourier transform the transmittance signal and produce a correlation plane image intensity signal.

Even more particularly, the apparatus of the present invention comprises one or more real-time, video-rate, spatial light modulators that can encode complex-valued 2-D images onto a collimated beam of laser light; appropriate optics for Fourier transforming complex-valued image; appropriate optics for interfering a plane wave with a light distribution representing the optical Fourier transform of an image; appropriate optics for shifting the phase of a plane wave by a know amount; means for recording the intensity of the interference patterns in all embodiments and also means for recording the intensity of the Fourier transformed image in some embodiments at real-time rates, typically with a video camera; and, means for decoding the phase of the Fourier transformed image in all embodiments and also the amplitude in some embodiments, typically by means of electronic circuits that process serial video signals.

I note that optically addressed SLMs with intelligent (electronically assisted) pixels can also be envisioned to implement this correlator without outputting a serial electronic signal. I note further that the correlator would also be able to perform convolution. Finally, I note even further that the electronic phase decoding circuit would also be useful in other applications where fringe-scanning interferometry needs to be performed at standard video rates or faster, for instance, in adaptive optical telescopes, and in applications where digital computers take up too much space or dissipate too much power, for instance, remote, portable or space-based sensors.

BRIEF DESCRIPTION OF THE DRAWINGS

A better understanding of the present invention will be had upon reference to the following description in conjunction with the accompanying drawings, wherein:

FIG. 4*b* showing a circuit, which, when used in place of the ATAN |Q/I| portion shown in FIG. 4*a*, provides four-bits of phase resolution; and, FIG. 4*c* showing modifications which can be made to that circuitry shown in the right half of FIG. 4*a* which will reduce the number of multiplier units; and, FIG. 5 shows the transfer function for a circuit with a nonlinearity of $\phi(x)=\tan^{-1} 10^x$.

DETAILED DESCRIPTION OF THE PREFERRED EMBODIMENTS

Figure 1:
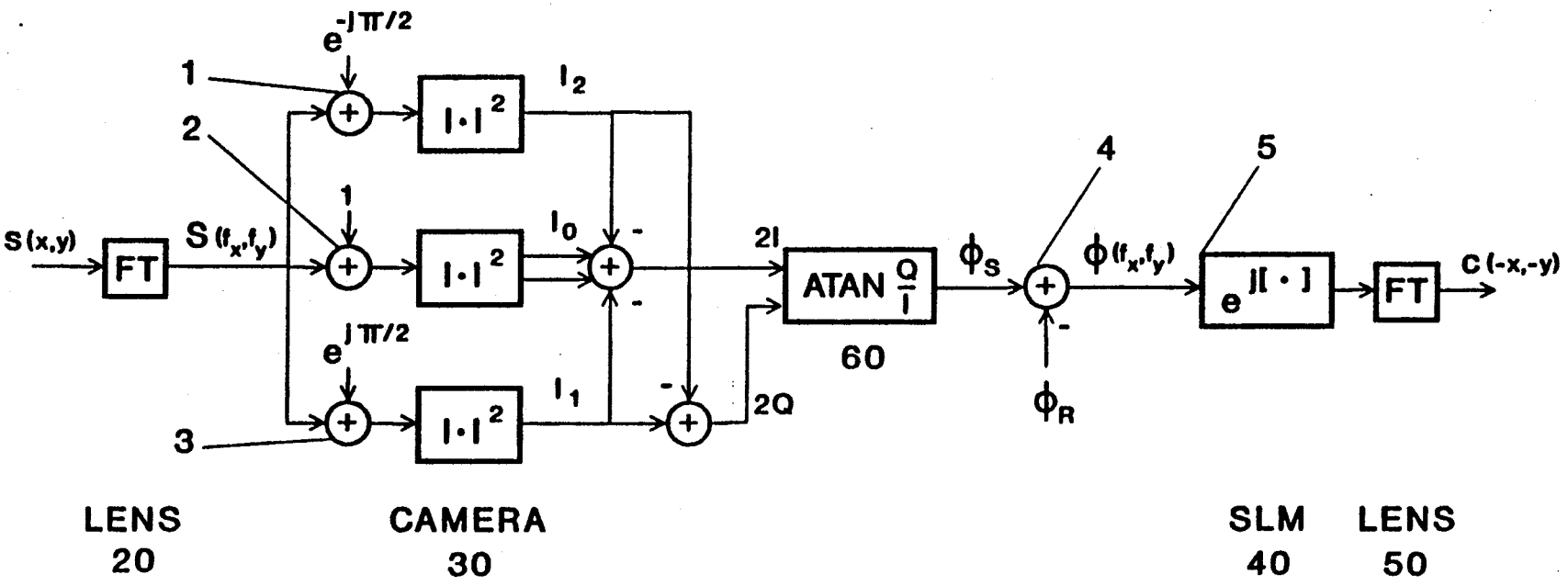
FIG. 1 shows the phase-only correlation algorithm for the specific case of phase shift $\phi_1=\pi/2$.

To provide a general description of a interferometer-based phase-only correlator, FIG. 1 shows the phase-only correlation algorithm for the specific case of phase shift $\phi_1=\pi/2$. This algorithm may be generalized by scaling I and Q by factors shown and described later with discussion of equation 3. The case of $\phi_1=2\pi/3$ is also discussed.

FIG. 1 illustrates the correlation algorithm in block diagram form. This describes the mathematical operations being performed, or approximated by the various embodiments. The components, e.g. lenses 20 and 50, camera 30, SLM 40, perform specific analog functions, described herein. The test image s(x,y) [and/or reference r(x,y)] is [are] Fourier transformed by lens 20, producing transform $S(f_x,f_y)$ [and/or $R(f_x,f_y)$]. The transform is interfered with three plane waves of identical intensity and known phase differences, represented mathematically by the summing of each of the complex exponentials with $S(f_x,f_y)$ at the summing junctions, identified as 1, 2, and 3. The intensity $I_i(f_x,f_y)$ of the i'th interference pattern would be:

$$I_i(f_x,f_y) = |\exp(j\phi_i) + |S(f_x,f_y)|\exp[j\phi_s(f_x,f_y)]|^2 = 1 + |S(f_x,f_y)|^2 + 2|S(f_x,f_y)|\cos[\phi_s(f_x,f_y) - \phi_i] \quad (1)$$

Measurements with three phases of $\phi_0=0$, $\phi_1$ and $\phi_2=-\phi_1$ allows the in-phase and quadrature components of the signal to be found by solving the two linear equations:

$$I_0 = I_i = 2|S|[\cos\phi_s(1-\cos\phi_i) - \sin\phi_s\sin\phi_i] = I(1-\cos\phi_i) - Q\sin\phi_i; \quad i=1,2 \quad (2)$$

to yield:

$$I = \frac{2I_0 - I_1 - I_2}{2(1-\cos\phi_1)} \quad (3)$$

$$Q = \frac{I_1 - I_2}{2\sin\phi_1}$$

This special case of phase measurement by fringe scanning interferometry uses a minimum number of discrete measurements in order to reduce data storage and maximize processing speed. As seen in FIG. 1, for plane wave phases of 0 and $\pm\pi/2$, the denominators of both I and Q, in equation 3, are equal to 2. An inverse tangent circuit 60 then converts the measurement of I and Q into a measurement of $\phi_S$, the phase of the signal spectrum S. The phase measurement $\phi_S$ has $\phi_R$, the phase of the reference spectrum R, subtracted from it at summing junction 4. For a real-time adaptive correlator, the phase of the reference spectrum $\phi_R$ is measured by an identical interferometer. The phase-only SLM 40 is programmed to impart the measured phase difference $\phi(f_x,f_y)$ to a collimated laser beam. The spatial modulation of the wavefront is shown as numbered box 5 containing exp[j.]. The SLM transmittance is Fourier transformed by lens 50 to produce the correlation plane image:

$$c(-x, -y) = \left[\frac{S(f_x, f_y)R^*(f_x, f_y)}{|S(f_x, f_y)R(f_x, f_y)|}\right] \quad (4)$$

Equation 4 indicates that both the reference spectrum R and signal spectrum S are set equal to a constant magnitude (i.e. "whitened") in this system. This differs from the phase-only correlator of Horner, taught in U.S. Pat. No. 4,588,260 and described in the background above, which only whitens the reference spectrum. The complex-valued spectrum of the test image in this type of correlator can be obtained, as before, by optical Fourier transform of s(x,y). It is then optically multiplied by the transmittance of the phase-only SLM, which is programed to be $\exp[-j\phi_R]$. Using a complex-valued SLM, see background on SLMs, especially Gregory, Kirsch, and Tam, in place of the phase-only SLM in the Horner phase-only correlator would further allow adaptive embodiments of the classical matched filter correlator. The phase would be determined as before and the spectral magnitude is directly observable by a camera followed by a square root circuit to convert intensity to magnitude. Adding adaptivity to the prior art correlators does not take full advantage of the compactness possible of the preferred embodiments described below. These two embodiments are described below as modified versions of the preferred embodiments.

Figure 2A:
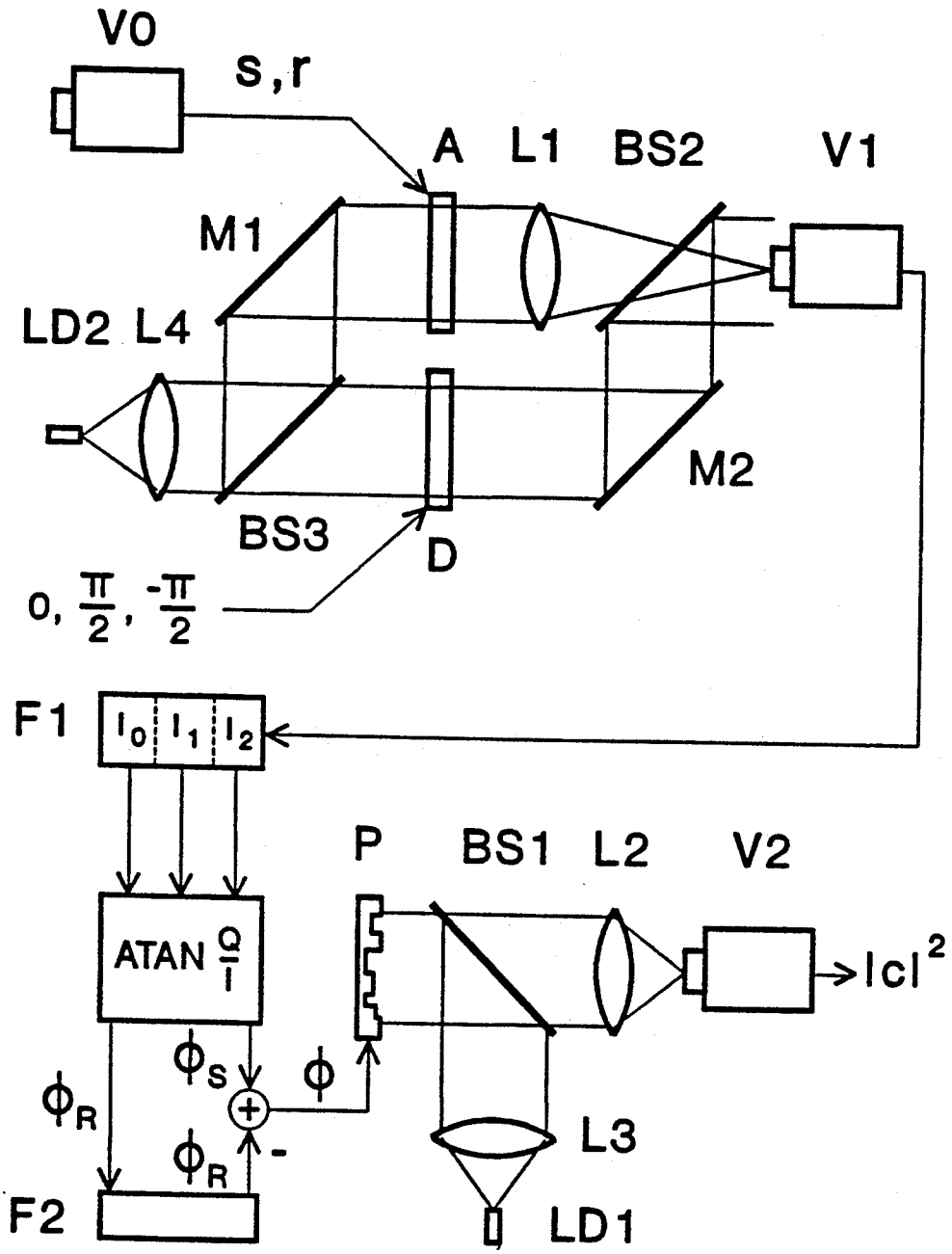
FIGS. 2*a–b* show an opto-electronic implementation of an adaptive phase-only correlator.

FIG. 2*a* shows one preferred embodiment, which is an optoelectronic implementation of an adaptive phase-only correlator. A identifies an amplitude-only slm; V is a video camera; D is a phase shifter; F is a video frame memory; P is a phase-only slm and is reflective, such as the FBDMD; LD is a laser; L is a lens; M is a mirror; and BS is a beam splitter. In this embodiment, the phase for scene and reference signals time share the interferometer, with the phase of the reference spectrum being determined and stored in frame memory until the phase of the scene spectrum is calculated, and then the two phases are subtracted.

In FIG. 2*a*, the front optics system is a mach-zehnder interferometer. The interferogram is formed on the imager of video camera V1, which is at the focal point of lens L1. The images s(x,y) and r(x,y) are shown being derived from the same video camera V0, or an equivalent video source. This demonstrates time sharing of the interferometer optics, rather than employing two identical interferometers.

The transmittance of A, the amplitude-only SLM, is first set proportional to the video reference image r(x,y) and the Fourier transformed image occurring at V1 is successively interfered with plane waves of three known phase shifts, shown as 0, $\pi/2$ and $-\pi/2$ in FIG. 2*a*. The three interferograms ($I_0$,$I_1$,$I_2$) are recorded by camera V1 and stored in frame memory F1. The same procedure is applied to test image s(x,y).

The phase shifter D can be realized by many well known means, such as with a transparent rotating wheel that is segmented into three different thicknesses, a piezoelectrically displaced mirror, or an electro-optic crystal.

While the first interferogram of s(x,y) is being recorded, the electronic circuit is converting the three interferograms of r(x,y) into phase $\phi_R$ and storing these measurements in frame memory F2. When the three interferograms of s(x,y) have been stored in F1, the electronic circuit identically calculates the phase $\phi_S$. As $\phi_S$ is being calculated, $\phi_R$ is recalled from F2 and subtracted from $\phi_S$ to yield the phase $\phi$ that is used to program P, the phase-only SLM. Phase-only SLM P in FIG. 2*a* represents a side view of the FBDMD. It is optically reflective, and each individual pixel is programmed to impart pure phase retardation of values $\phi(i,j)$, determined previously by fringe scanning, at the i,j'th pixel. The lens L2 Fourier transforms the SLM transmittance, which is then recorded as $|c(x,y)|^2$ by the camera V2.

I note that a small amount of electronics makes unnecessary individual interferometers for evaluating r and s. The electronic subtraction of the two phases replaces the step of optical multiplying transmittances $\exp(j\phi_S)$ and $\exp(j\phi_R)$, and, thus eliminates the need for a second phase-only SLM. For the correlator to be adaptive in real-time, six interferograms must be recorded for each scene that is to be evaluated. Only one optical transform of the phase-only SLM is produced per scene.

The mach-zehnder interferometer was chosen in order to eliminate all tilt from the reference, or lower path, beam. Tilt can cause rapid spatial variation of the interferogram which would be averaged out by the large fill factor pixels of most ccd cameras. It is therefore important to keep the spatial variation of the interferogram to below the Nyquist frequency of the image. If detectors of infinitesimal extent, which can be approached in practice by placing a sampling mask over the detector array, or an imager that oversamples the image are used, then a tilted reference can be used to illuminate the camera. This will relieve the need for the beamsplitter immediately in front of the camera. As opposed to JTC and Vander Lugt correlators, which also produce autocorrelation and convolution products, tilt or linear phase modulation is not required to separate these products.

Figure 2B:
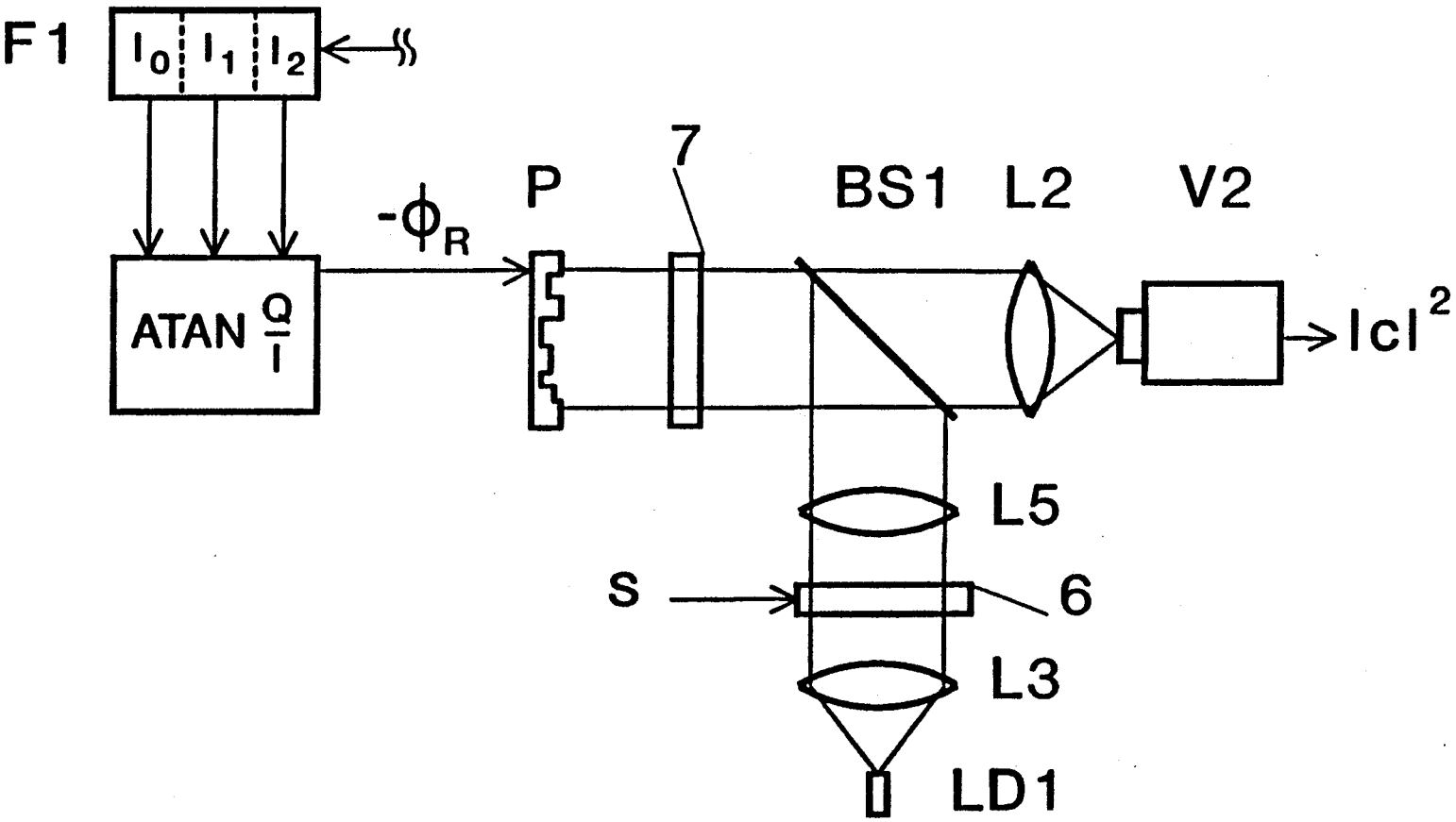

A real-time adaptive embodiment of the Horner phase-only correlator would result by modifying the correlator of FIG. 2*a* in the manner shown in FIG. 2*b*. Camera V0 would only use the interferometer to determine the phase $\phi_R$ of the reference image. The negative of this phase would be electronically programmed onto SLM P. The complex-valued spectrum of the test signal $S(f_x,f_y)$ is obtained by the lens Fourier transform of the modulation s(x,y) on an SLM 6. The amplitude-only SLM 6 programmed with s(x,y) and transform lens L5 can be placed between the lens L3 and beamsplitter BS1. As stated above, this specific embodiment overcomes the previous lack of adaptivity in the Horner phase-only correlator.

A real-time adaptive embodiment of the classical matched filter correlator would result by further modifying the adaptive Horner phase-only correlator described above. In this embodiment, a transmissive amplitude-only SLM 7 is placed in proximity to the Fourier plane between P and BS1, as shown in FIG. 2*b*. Gregory, Kirsch, and Tam describe equivalent optical arrangements that do not require the physical co-location of amplitude-only SLM and phase-only SLM. The amplitude-only SLM is programmed to $|R(f_x,f_y)|$. The amplitude is found by one of two means. If a shutter is used to block the lower path of the interferometer in FIG. 2*a*, then the camera will directly record the intensity spectrum of r(x,y). An electronic means of taking a square root of the intensity is then used to produce the amplitude that is to be programmed on the amplitude-only SLM. A preferred method, which eliminates the need for the shutter, is to determine the spectral intensity from the $I^2+Q^2$, since I and Q are intermediate terms determined by the inverse tangent circuit.

Figure 3A:
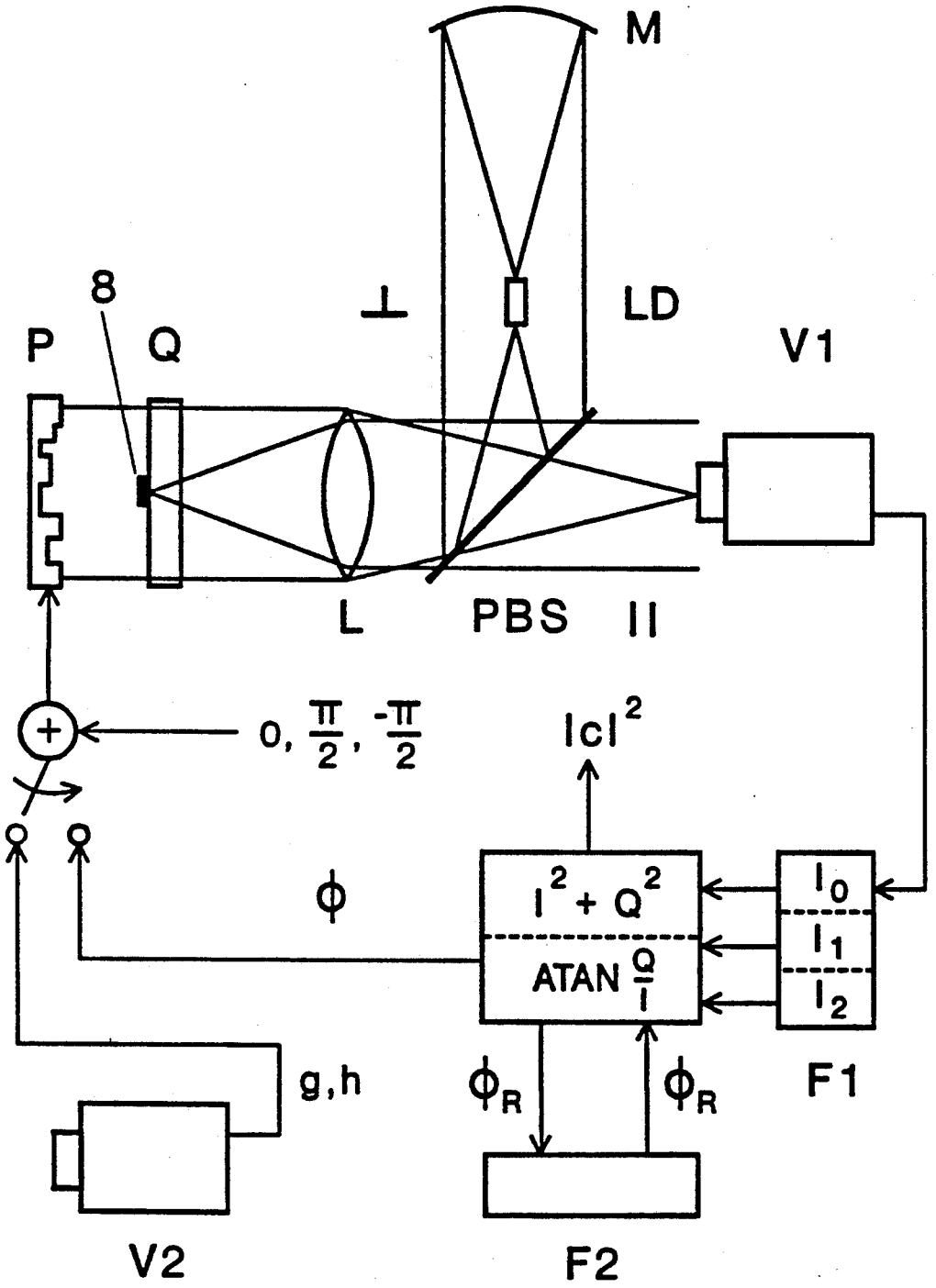
FIGS. 3*a–b* show a compact, energy-efficient implementation of an adaptive phase-only correlator.

Physically compact implementations are currently desired for many systems, and FIG. 3*a* shows the preferred embodiment of an especially compact, energy-efficient implementation of an adaptive phase-only correlator. M is a curved mirror; LD is a laser diode, radiating from front and back facets; L is a lens; P is a phase-only SLM; Q is a quarter wave plate; V is a video camera; F is a video frame memory; and PBS is a polarized beam splitter.

The quarter wave plate Q has a mirror 8 of small area deposited on its front surface. The quarter wave plate Q and the polarized beam splitter PBS are used together to efficiently direct light from the laser illuminator to the video camera V1. The SLM P also performs the function of phase shifting. The optical system performs common path interferometry of the Fourier transform of the transmittance of the phase-only SLM. The video scene g(x,y) and reference scene h(x,y) are now nonlinearly transformed by the phase-only SLM into the optical signals $s(x,y)=\exp[jg(x,y)]$ and $r(x,y)=\exp[jh(x,y)]$. The phase shifting operation is performed by offsetting the phase of each SLM pixel by 0, $\pi/2$, and $-\pi/2$ in successive frames. This follows from the linearity of the Fourier transform, where, in this case, the Fourier transform is being linearly scaled by a complex and unit magnitude constant. The nonlinear transform of the scene by the SLM may reduce the performance of the correlator over using a magnitude-only SLM. Magnitude-only performance may be approximated by small phase modulation depth or by binary thresholding of the scene followed by mapping of pixels above threshold to 1 (0 radians) and below threshold to $-1$ ($\pi$ radians). The first mapping strategy leaves a large DC peak in the transform plane, while the second mapping is identical to a binary-weight magnitude-only SLM, except for a shift in the DC level. The performance of the interferometer will also be affected by the accuracy in identically off-setting the phase of each pixel of the SLM.

As in the previous embodiment, no shuttering of the reference arm of the interferometer is required. Also the SLM phase shifting eliminates the need for a separate phase-shifting device. For this correlator to be adaptive in real-time, nine frames per scene are required. Note that 4 kHz frame rates have been reported for recent DMDs which could be used to provide processing rates substantially in excess of standard video. See background SLM, especially R. M. Boysel.

The polarizing beam splitter PBS and quarter wave plate Q are included to overcome beamsplitter losses from the signal and reference beams. Symbols ⊥ and || have been included to indicate the linear polarization; perpendicular, ⊥, to the left and parallel, ||, to the right of the polarizing beam splitter PBS. They also keep unwanted reflections from several surfaces from reaching the camera. In order to approach a 100% collection of the light, some obscuration from the laser diode of the reference beam and the small mirror 8 of the signal beam is incurred. The reference beam can fill-in around the laser diode by diffraction and spatial filtering of the mirror 8. The SLM illumination beam can also diffract around the small mirror 8 and the optical Fourier transform can smooth out some of the errors and interference from these secondary wavelets. In order to minimize obscuration of the laser diode, it can be embedded in a transparent substrate, perhaps diamond, which is also an excellent thermal conductor; and, transparent electrodes, such as indium tin oxide, can be used to conduct electricity to the laser diode. Most laser diodes emit from both back and front surfaces. With proper design, it is possible to emit any ratio of intensities between the front and back surfaces.

Figure 3B:
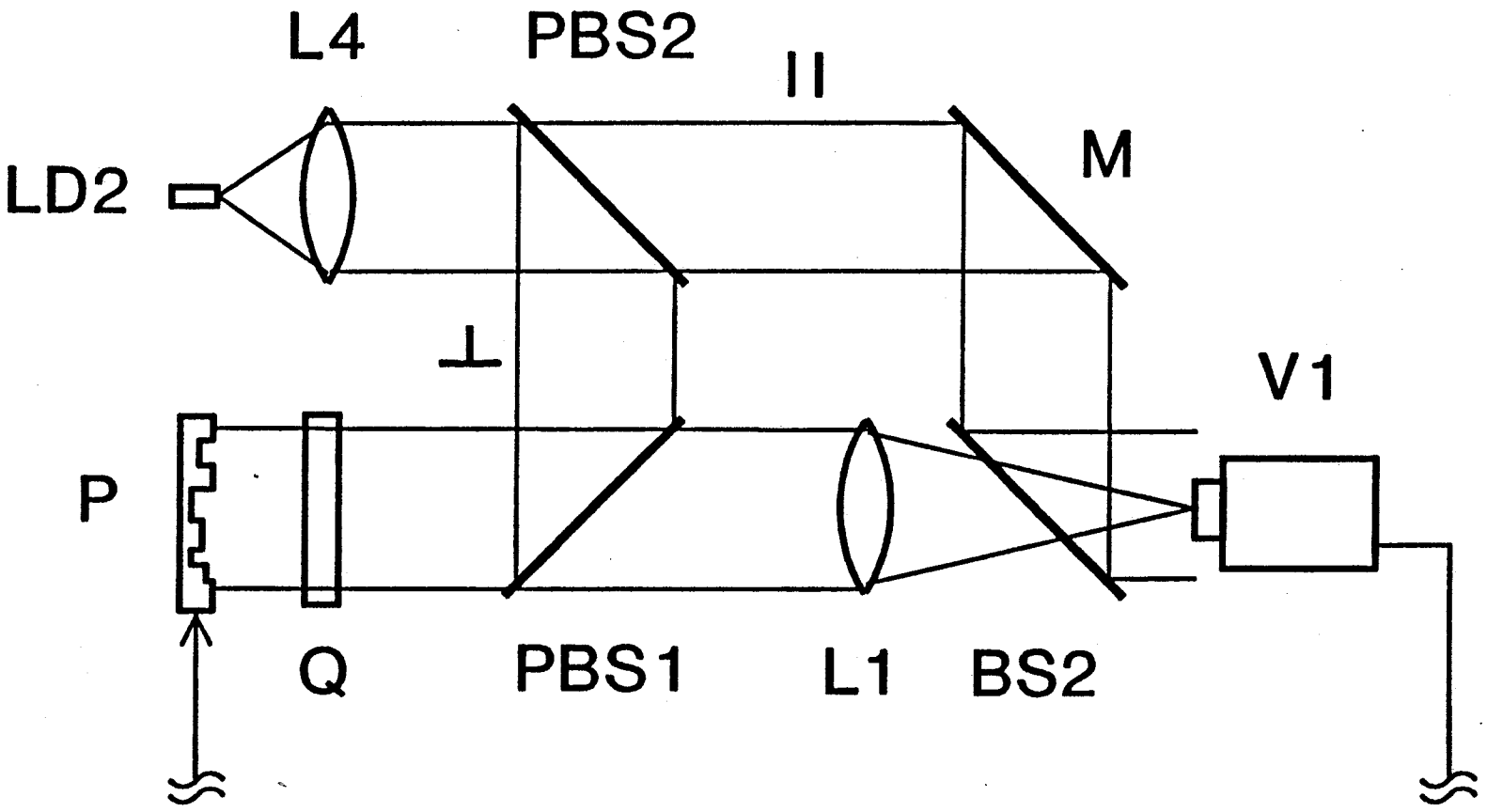

A mach-zehnder implementation with no obscurations can also be made as shown in FIG. 3*b*. A quarter wave plate and polarizing beamsplitter behind the FBDMD can be used to recover the light reflected from the FBDMD. However, assuming a 50/50 non-polarizing beam splitter in front of the camera, only 50% of the signal and reference beam will reach the camera V1.

The serial rates required to calculate the phase is controlled by the SLM frame rate and the number of SLM pixels. For example, a 30 frame per second, $128\times128$ SLM sets a rate of $0.5\times10^6$ calculations per second. If the fully time-shared architecture of FIG. 3 is used, then the calculation rate is increased by a factor of nine. Many have stated an interest in pushing SLMs to $10^6$ pixels and 1 kHz frame rates, indicating rates of $10^9$ calculations per second. For example, J. A. Neff, "Major initiatives for optical computing," Optical Engineering, Vol 26, pp. 2–9 (January, 1987), discusses the research goals of DARPA. Cameras containing imagers of similar resolution and frame rate would also be needed for these faster systems.

Analog or digital versions are possible, but it is expected that analog versions would achieve the greatest speeds and have the smallest size and lowest power dissipation. The all-digital approach would add costs for A/D and D/A convertors, and arithmetic units Digital division can be slow, while analog division can be done using log amps. CCD arrays are envisioned as the frame memory for the $I_i$ and $\phi_R$ in analog implementations. The memory requirement for the three interferograms can be reduced from three frames to two frames by storing the data as $Z_1=I_0-I_1$ and $Z_2=I_0-I_2$. Equation 3 can easily be reexpressed in terms of these linearly transformed variables $Z_1$ and $Z_2$.

Figure 4A:
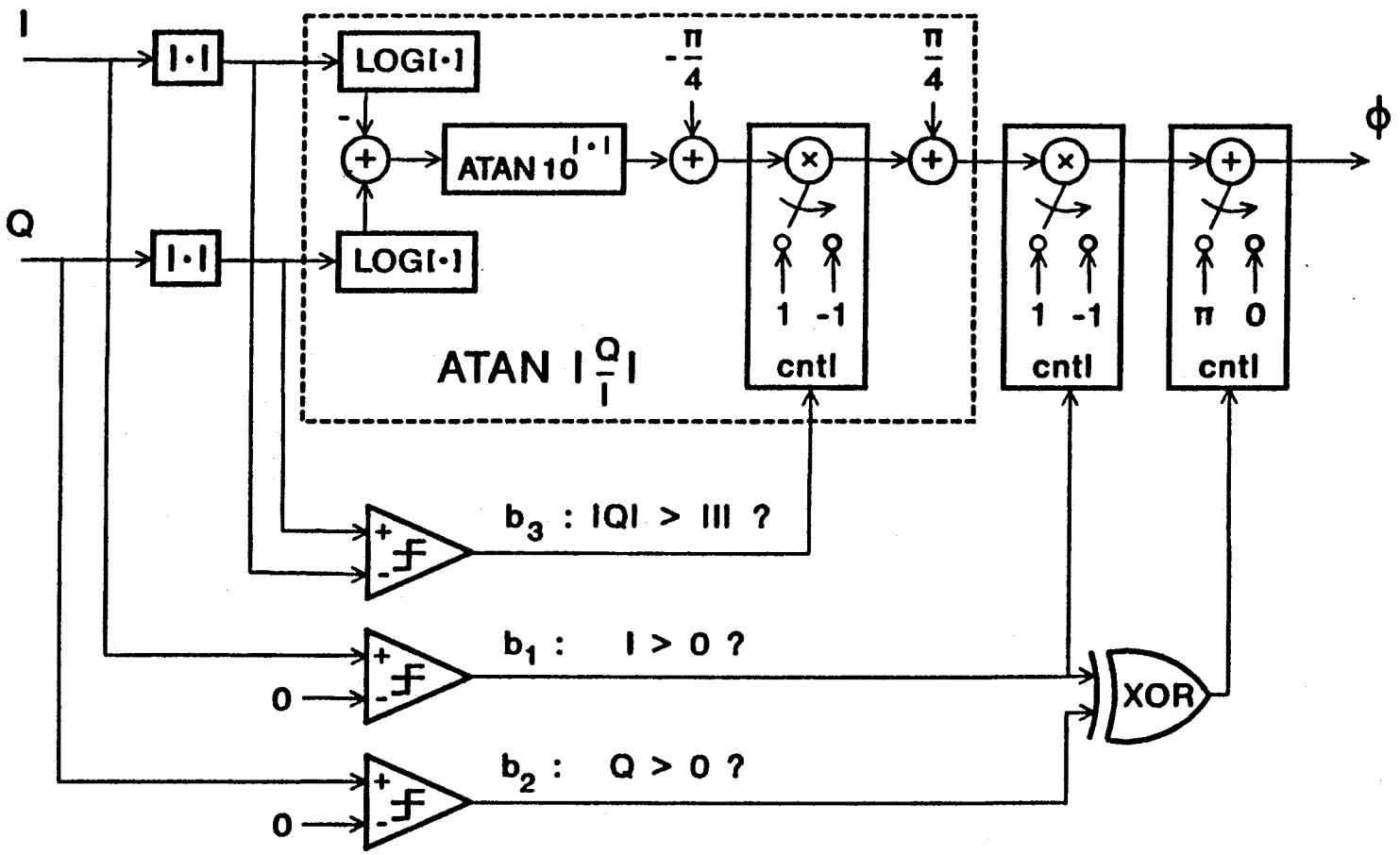
FIGS. 4*a–c* show an analog implementation of the inverse tangent circuit; with FIG. 4*a* showing a specific implementation using log amps.
Figure 4B:
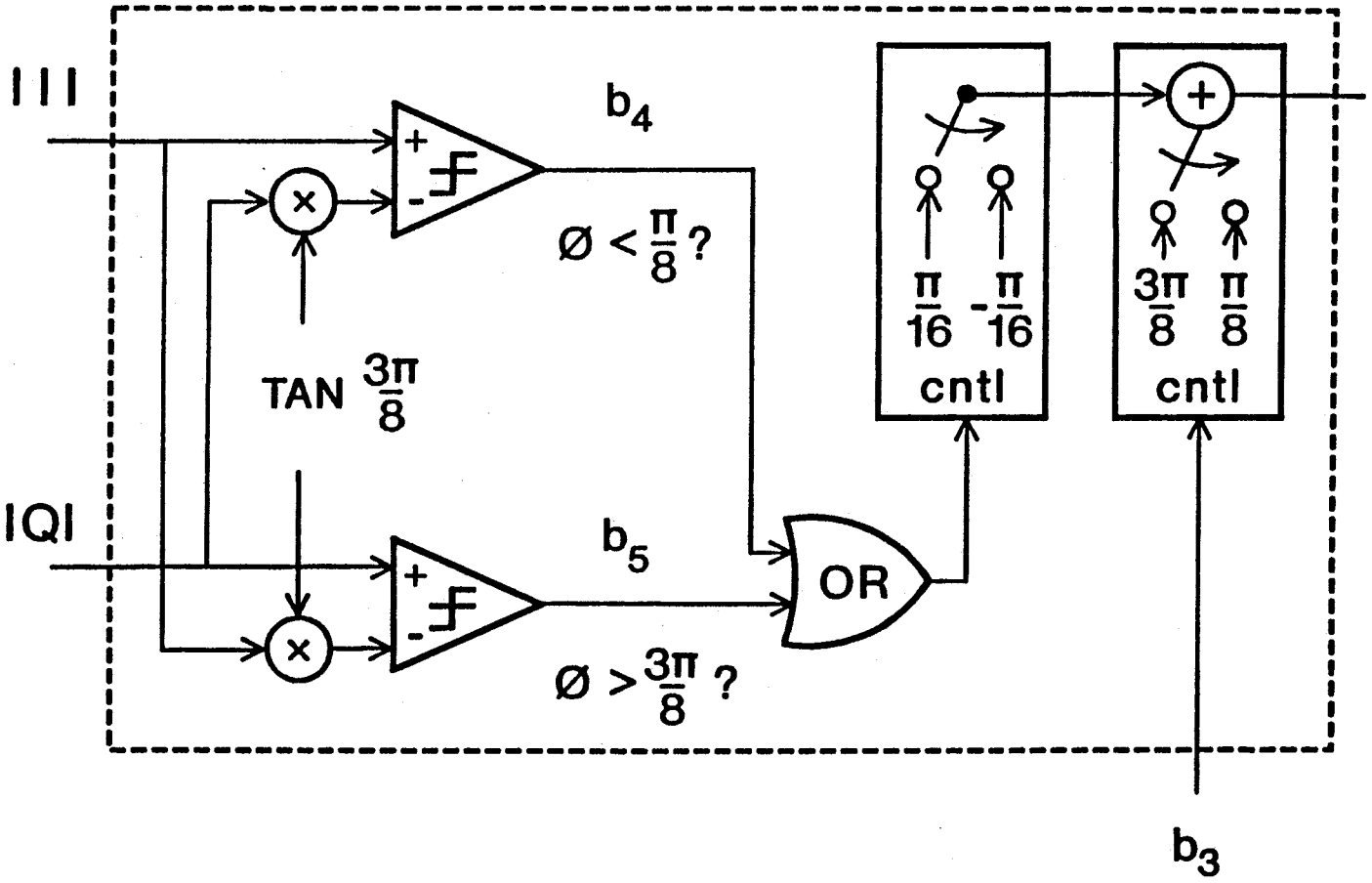
Figure 4C:
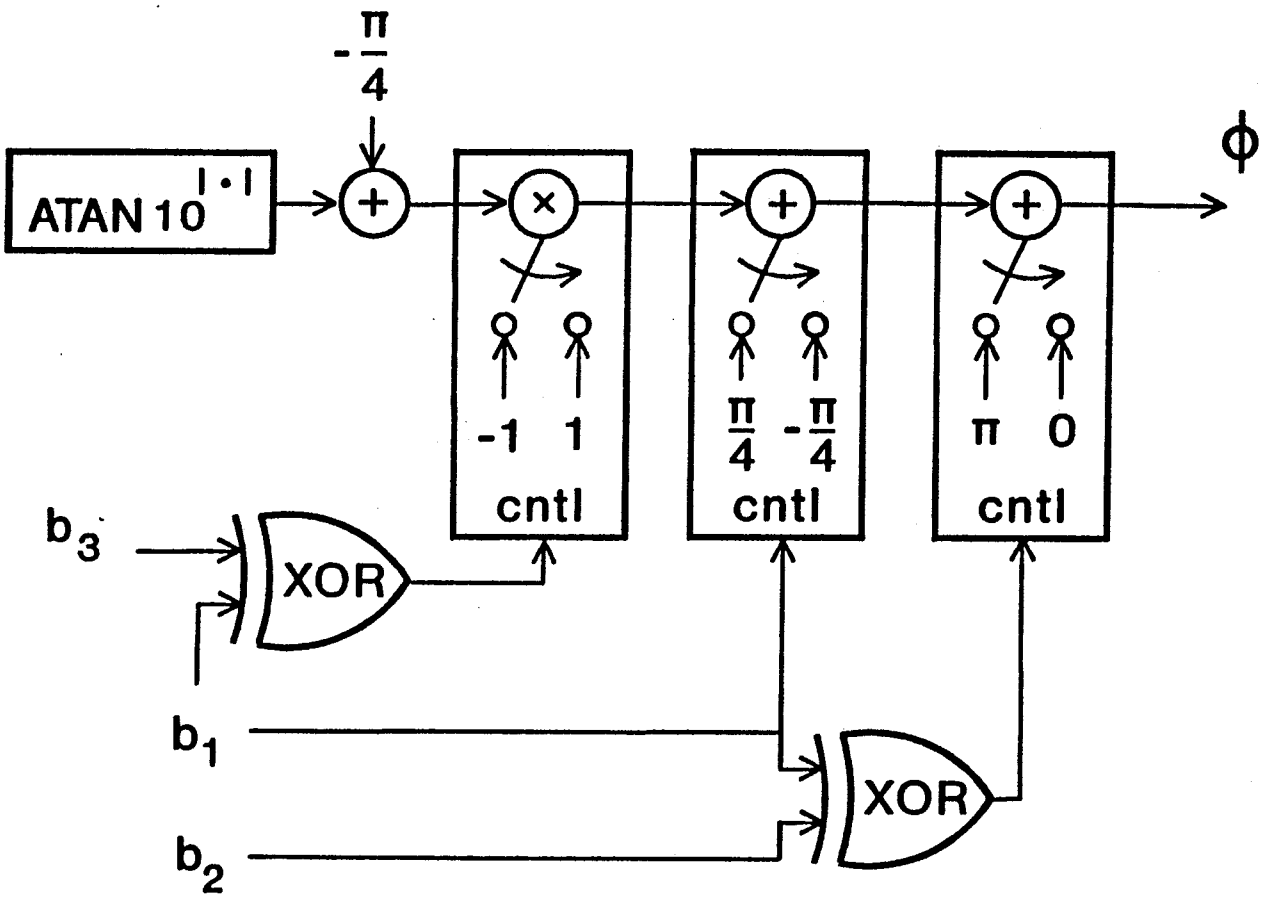

FIGS. 4*a–c* show analog implementations of the inverse tangent circuit. FIG. 4*a* shows a specific implementation using log amps. Symmetry of the function has been used to limit the dynamic range of the log amps and the $\tan^{-1}$ $10^x$ amplifier. The comparators determine in which octant of the unit circle the phase lies and the switching circuits place the phase in the correct octant. FIG. 4*b* shows a circuit which, when used in place of the ATAN $|Q/I|$ portion shown in FIG. 4*a*, provides four-bits of phase resolution. FIG. 4*c* shows modifications to the right half of the circuitry shown in FIG. 4*a* that reduces the number of multiplier units. All switches in FIGS. 4*a*, 4*b* and 4*c* are shown set to the true state.

Figure 5:
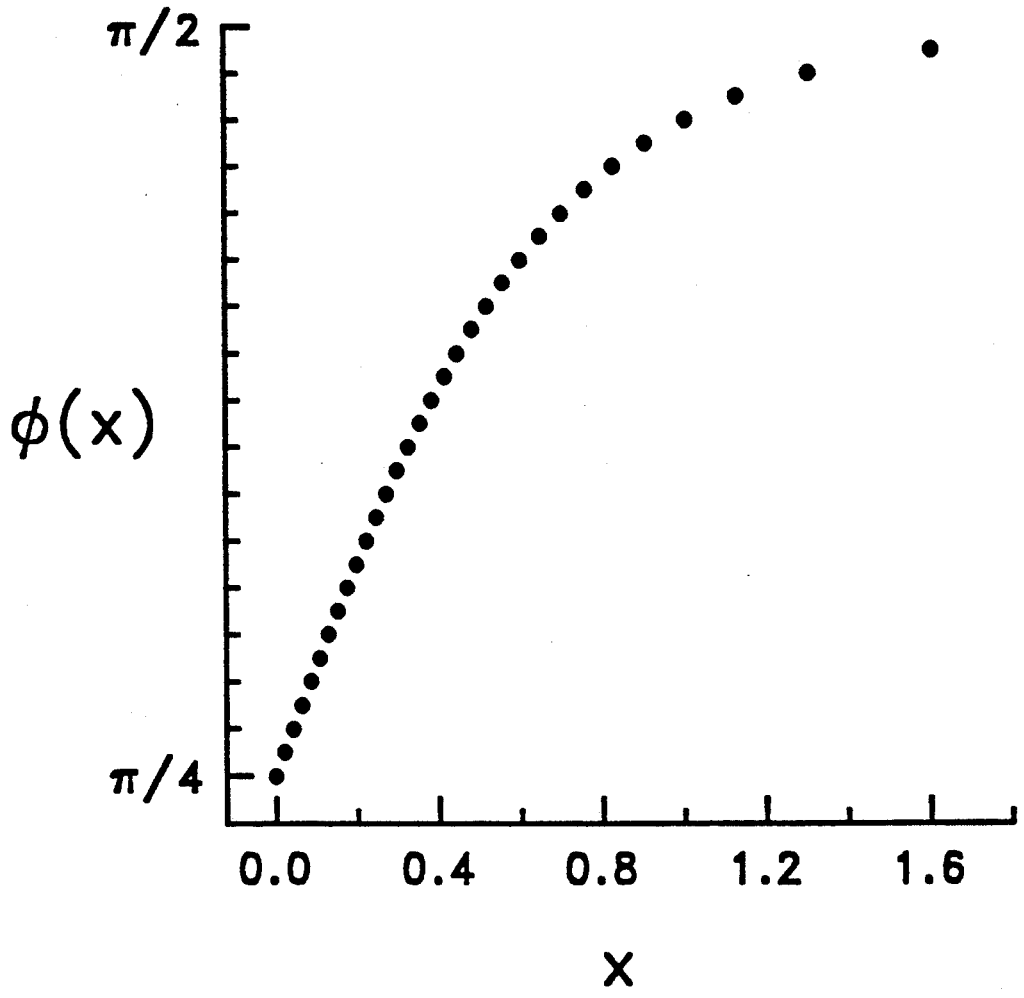

FIG. 5 shows the transfer function for a circuit with a nonlinearity of $\phi(x)=\tan^{-1} 10^x$. The curve shows samples of this function with a resolution of eight bits on the unit circle (i.e. $\Delta_8=2\pi/256$).

With reference to the block diagram of an analog implementation of the inverse tangent circuit of FIG. 4*a*, the portion of the circuit inside the dashed box produces output values between 0 and $\pi/2$. The log amplifiers and the subsequent nonlinear amplifier together perform the division, inverse tangent function and a $\pi/4$ level shift. The output of this last amplifier only varies between 0 and $\pi/4$, as shown by the FIG. 5 graph. The third detection bit indicates whether the output value for this amplifier should be placed between $\pi/4$ and $\pi/2$ (for b3 true) or 0 and $\pi/4$ (for b3 false). I have used the result that the tangent is a symmetric reflection of the cotangent around $\pi/4$. This allows the same amplifier transfer function to be used to calculate either range of the phase. Bits 1 and 2 enable the phase to be placed in the proper quadrant. When determination of phase to 4 bits ($\pi/8$ resolution) is deemed adequate, then the circuit in the dashed box in FIG. 4*a* may be replaced by that shown in FIG. 4*b*. In developing the high accuracy phase determination circuit of FIG. 4*a*, the nonlinearity may be somewhat distorted to correct for systematic errors earlier in the circuit. An additional nonlinear amplifier could follow the circuit in order to compensate for any nonlinear mapping of the voltage $\phi$ to FBDMD pixel displacement. It is likely that there is an off-the-shelf circuit for performing arbitrary $\gamma$-correction of video cameras that can be adjusted to approximate these various nonlinear amplifiers.

The multipliers in FIG. 4*a* could be implemented by switching between outputs of a complementary output device. A potentially simpler arrangement of the multiplier blocks and adders is shown in FIG. 4*c*. The two adders can also be represented by a single four-position switch.

FIG. 4*a* is quite similar, especially in the use of comparators, to the circuit of Ichioka and Inuiya, and both are based on taking advantage of symmetry of the arctangent function. Of course, the demodulation into I and Q is entirely different from Ichioka and Inuiya using video frame memories shown in FIGS. 2 and 3. Low cost video memories would not have been available to them. I have further specialized my circuit in FIGS. 4*b*,*c* to especially simple circuits capable of up to 4 bits of phase resolution without using nonlinear log and atan functions. With 4 bits of resolution significant reductions in noise and improvements in diffraction efficiency over binary phase only correlators would be possible. The paper by R. W. Cohn, especially FIG. 5, indicates that 4 bits resolution (around 0.1 wavelength piston error) my correlator could achieve a diffraction efficiency of greater than 95%.

Whether or not the measured phase is quantized, additional sources of error can propagate into the phase measurements which will can also reduce diffraction efficiency of the correlator. Most apparent are camera thermal noise and the limit it sets on the dynamic range of the interferometer. The establishment of dynamic range limits will also reduce the complexity and cost of the circuits used in the inverse tangent circuit.

The dynamic range of the interferometer is defined as the ratio of the maximum possible optical amplitude $a_{max}$ to the minimum amplitude $a_{min}$ needed to measure phase $\phi$ to a given resolution $\Delta$. It is limited by ratio of the maximum intensity $I_{max}=(1+a_{max})^2$ observed by the interferometer plane camera and its minimum detectible signal level $\sigma$, which is treated here as the standard deviation of a thermal noise limited detector. The camera signal-to-noise ratio $S/N=I_{max}/\sigma$ is considered to be equivalent to its dynamic range.

The propagation of camera noise into the measurements of I and Q is found from the standard deviation of each part of equation 3:

$$\sigma_I=\sqrt{\frac{3}{2}}\ \frac{\sigma}{1-\cos\phi_1} \qquad (5)$$

$$\sigma_Q=\sqrt{\frac{1}{2}}\ \frac{\sigma}{\sin\phi_1}$$

If a phase shift $\phi_1$ of $2\pi/3$ is used, then the measurements of I and Q will be equally noisy having:

$$\sigma_I=\sigma_Q=\sqrt{\frac{2}{3}}\ \sigma \qquad (6)$$

At angles of $\phi$-$\Delta$ close to $\pi/2$, I is much smaller than Q, and thus much more affected by measurement noise. Then defining $\sigma_I$ as the minimum detectible in-phase component, $a_{min}$ can be related to $\Delta$ by rearranging equation 3 as:

$$a_{min}=\frac{\sigma_I}{2\cos(\pi/2-\Delta)}=\frac{\sigma_I}{2\sin\Delta} \qquad (7)$$

Using the relationships in this section, including the specific result in equation 6, the dynamic range of the interferometer can be expressed as:

$$\frac{a_{max}}{a_{min}}=\sqrt{6}\ \sin\Delta\ \frac{S}{N}\ \frac{a_{max}}{(1+a_{max})^2} \qquad (8)$$

The maximum dynamic range D (when $a_{max}=1$) is:

$$D=\sqrt{\frac{3}{8}}\ \frac{S}{N}\sin\Delta \qquad (9)$$

This is the main result desired. Many black-and-white cameras have advertised specifications for S/N of from 200:1 to 1000:1 (46 dB to 60 dB) and ccd detector arrays have S/N of around 80 dB. See, for instance, E. L. Deraniak and D. G. Crowe, *Optical Radiation Detectors*, Ch. 9, J. Wiley, New York (1984). For camera S/N of 1000:1, equation 9 indicates that the interferometer has a dynamic range of 60 for six bits of resolution ($\Delta_6=2\pi/64$) and 15:1 for 8 bits ($\Delta_8=2\pi/256$). In order to appreciate the sensitivity of the interferometer using S/N of 1000:1, note that it would be possible to measure the phase of a sinc function at the peak of its nineteenth sidelobe with a resolution of $\Delta_6$ and at the peak of its fifth sidelobe with a resolution of $\Delta_8$.

The definition of dynamic range in equation 9 is somewhat arbitrary. A rough check of its validity is can be accomplished by evaluating the worst-case perturbation of $\phi$ to a one standard deviation error in I and Q; i.e., $$\phi + \delta\phi_{\pm} = \tan^{-1}\left(\frac{Q(a) \pm \sigma_Q}{I(a) \mp \sigma_I}\right); a = a_{min} \quad (10)$$

For the case of phase shift interval $\phi_1 = 2\pi/3$, the perturbation decreases from roughly $\pm 1.0\Delta$ to $\pm 1.4\Delta$ as $\phi$ decreases from $\pi/2$ to $\pi/4$, which is the range of the $\tan^{-1}(10^x)$ circuit of FIG. 4a. For the same numerical value of $a_{min}$, but with $\phi_1 = \pi/2$, the perturbation is somewhat larger, being between $3/2\Delta$ to $5/3\Delta$.

The analog circuitry must also have adequate performance to achieve the desired resolution. Approximating only one-eighth of the unit circle, as described above, reduces the dynamic range required to calculate phase to the desired resolution $\Delta$. For example, the dynamic range of Q/I is 8.3:1 over the range $\pi/4+\Delta_6$ and $\pi/2-\Delta_6$ and 39:1 over the range $\pi/4+\Delta_8$ and $\pi/2-\Delta_8$. The dynamic range of either I or Q will be larger than the dynamic range of I/Q by the factor D (see equation 9.) Therefore, either log amp must be able to handle a dynamic range of at least 500:1 for $\Delta_6$ and 580:1 for $\Delta_8$. The dynamic range of log(Q/I), which is the input of the $\tan^{-1}(10^x)$ circuit, is 12:1 for 6-bit resolution and 76:1 for 8-bit resolution. The dynamic range of the output of the $\tan^{-1}(10^x)$ circuit need not be much greater than that set by the achievable resolution. This calls for a dynamic range of $2^{n-3}$ to achieve a resolution of $\Delta_n$. The dynamic range required is greatest for the log amps, but still well within the performance limits of current video-rate analog components.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. An apparatus for performing optical correlation of a complex-valued two-dimensional test image and a complex-valued two-dimensional reference image, comprising:

(a.) means to determine the Fourier spectrum of a test and a reference image and produce a test image Fourier transform light distribution and a reference image Fourier transform light distribution;

(b.) means to interfere said test and reference image Fourier transform light distributions with three reference plane waves, said reference plane waves being phase-shifted from each other by known amounts, thereby producing three test image and three reference image interferogram patterns;

(c.) means to electronically convert with a real-time image sensor the recorded three test image interferogram patterns into a test image phase signal and convert the three reference image interferogram patterns into a reference image phase signal;

(d.) means to subtract the reference image phase signal from the test image phase signal to yield a difference signal and identically modulate a phase-only spatial light modulator with the difference signal producing a phase-only transmittance signal; and, (e.) means to Fourier transform the transmittance signal and produce a correlation plane image intensity signal.

2. The apparatus of claim 1, wherein the means to determine the Fourier spectrum of a reference image and produce a reference image Fourier transform light distribution and means to interfer said reference image Fourier transform light distribution with three reference plane waves, said three reference plane waves being phase-shifted from each other by known amounts, thereby producing three test image interferogram patterns comprises a mach-zehnder interferometer.

3. A method of performing optical correlation, comprising the steps of:

(a.) using lenses to Fourier transform images in real-time of a test and a reference image which are represented on spatial light modulators, producing a test image Fourier transform light distribution and a reference image Fourier transform light distribution;

(b.) interfering said test and reference image Fourier transform light distributions with three plane wave reference signals, said plane wave reference signals being phase-shifted from each other by known amounts, thereby producing three test image and three reference image interferogram patterns; (c.) recording the interferogram patterns with a real-time image sensor;

(d.) electronically converting the recorded three test image interferogram patterns into a test image phase signal and converting the three reference image interferogram patterns into a reference image phase signal;

(e.) electrically subtracting the reference image phase signal from the test image phase signal yielding a difference signal and identically modulating a phase-only spatial light modulator with the difference signal producing a phase-only transmittance signal; and, (f.) using a lens to Fourier transform the transmittance signal producing a correlation plane image intensity signal.

4. The method of claim 3, further comprising the step of using a real-time image sensor to record the correlation plane image intensity signal and evaluating the correlation plane image intensity signal.

5. A method of performing real-time optical correlation, comprising the steps of:

(a.) using a lens to Fourier transform a reference image which is represented on a spatial light modulator, producing a reference image Fourier transform light distribution;

(b.) interfering said reference image Fourier transform light distribution with three plane wave reference signals, said plane wave reference signals being phase-shifted from each other by known amounts, thereby producing three reference image interferogram patterns;

(c.) recording the three reference image interferogram patterns with a real-time image sensor;

(d.) electronically converting the recorded three reference image interferogram patterns into a reference image phase signal;

(e.) modulating the phase of a phase-only spatial light modulator with a signal representing the negative of said reference image phase signal;

(f.) using a lens to Fourier transform a test image which is represented on an amplitude only spatial light modulator, producing a test image phase signal;

(g.) optically subtracting the reference image phase signal from the test image phase signal to produce a transmittance signal; and, (h.) using a lens to Fourier transform the transmittance signal producing a correlation plane image intensity signal.

* * * * *